US005889246A

United States Patent [19]

Frank et al.

[11] Patent Number: 5,889,246

[45] Date of Patent: Mar. 30, 1999

[54] AUTOMOTIVE BRAKE SWITCH

[75] Inventors: Carl Frank, Sharon; Mark Susser, Weston, both of Mass.; Mark S. Grimes, Sterling Heights, Mich.

[73] Assignees: Joseph Pollak Corporation, Boston, Mass.; Chrysler Corporation, Auburn Hills, Mich.

[21] Appl. No.: 782,215

[22] Filed: Jan. 13, 1997

[51] Int. Cl.[6] ..... H01H 3/14

[52] U.S. Cl. ..... 200/61.89

[58] Field of Search ..... 200/61.89, 16 B, 200/86.5, 321, 327; 340/479

[56] References Cited

U.S. PATENT DOCUMENTS

| | | | |
|---|---|---|---|
| 4,239,947 | 12/1980 | Breitung et al. | 200/61.89 |
| 4,316,065 | 2/1982 | Rupp et al. | 200/61.89 |
| 5,162,625 | 11/1992 | Comerford | 200/61.89 |

*Primary Examiner*—Corrine McDermott
*Assistant Examiner*—Michael J. Hayes
*Attorney, Agent, or Firm*—Kenway & Crowley

[57] ABSTRACT

An automotive brake switch including a body having a linearly traveling profiled carriage which makes or breaks various circuits as the carriage travels. The switch includes a plunger which, at first, is free to move relative to the carriage, but upon installation is locked to the carriage. A rotatable lever arm holds the carriage in a desired neutral operating position, and maintains free movement of the plunger relative to the carriage. When the switch body is installed, the plunger comes into contact with an arm of the brake which causes the brake to move against the force from a spring to assume a desired adjustment position relative to the carriage for proper operation. The rotatable lever arm is turned to lock the plunger to the carriage and to free the carriage for travel within the body. Thereafter, the carriage responds to movement of the plunger caused by the brake arm to make and break circuits in the normal fashion to control the operation of cruise control, stop lamps, etc. Also, the length of the carriage is somewhat less than the space provided in the switch body. This permits overtravel of the carriage within the body without causing readjustment.

13 Claims, 3 Drawing Sheets

AUTOMOTIVE BRAKE SWITCH

FIELD OF THE INVENTION

The present invention relates in general to automotive switches, and in particular to a brake switch which automatically self-adjusts upon installation in a vehicle.

BACKGROUND OF THE INVENTION

There are many situations, particularly in the automotive industry, where the proper operation of signals, the action of vehicle components, and even the safety of an operator are dependent upon precise timing and actuation of electrical switches. For example, reliable operation of switches which control the operation of power brakes, the energization of stop lamps, the disconnection of cruise control, and the energization of various warning and indicator lights, is critical in maintaining operator safety. When such switches are maladjusted, either during factory installation or by operator action, a hazardous condition can result. Also, even in the event that the maladjusted switch does not effect operator safety, vehicle battery failure may occur when lights such as stop lamps remain energized at all times.

The construction and proper installation of such switches, and recognition of their importance for safety and other reasons are, therefore, well understood. The nature of the automotive manufacturing business is such, however, that all components including the switches are most efficiently installed and adjusted at optimum working conditions in the factory, as the vehicle is assembled. Later handlers of the vehicle such as retail dealers frequently have neither the equipment nor the skilled personnel needed to accomplish the job as well as it can be done in the factory.

Even at the factory, however, it is preferred to have standard adjustments made rather than leaving the adjustments to the individual manual skills of the assembly line worker. For example, to adjust for appropriately timed switch actuation in the prior art, an assembly line worker installed the switch and then pulled upon the brake pedal to push in a plunger and set the position of the plunger for operation. Since the size and strength of the worker installing the switch varied, there probably resulted an over-adjustment or under-adjustment depending on the strength of the person that installed the switch.

Also, even if the prior art brake switches were installed and adjusted correctly at the factory, a vehicle operator could accidentally over-adjust the switch by hooking a foot under the brake pedal. When this occurred, the brake lights would remain on, the battery would go dead, or switch components could be damaged. The operator would then have to bring the vehicle to a dealer to readjust or replace the switch.

Accordingly, there is a need in the art for an automotive switch, particularly an automotive brake switch, which is self-adjusting, and which may not be inadvertently readjusted or damaged by upward movement of the brake pedal.

OBJECTS OF THE INVENTION

Thus, a primary object of the present invention is to provide an automotive switch which requires little if any individual adjustment on the assembly line or in later use.

Another object of the present invention is to provide a switch which eliminates the possibility of damage or readjustment resulting from overtravel of the switch components when the brake pedal is forced upward.

A further object of the invention is to reduce the cost and difficulty of assembling delicate parts in a vehicle.

A still further object of the present invention is to reduce the cost and improve the quality of vehicles as delivered to a customer.

These and other objects of the present invention will become apparent from a review of the description provided below.

SUMMARY OF THE INVENTION

The present invention is organized about the concepts of: (1) automatically and uniformly setting the switch in its normal operating position upon installation, and (2) preventing inadvertent loss of adjustment or damage of the installed switch. The switch of the present invention includes a body having a linearly traveling profiled carriage which makes or breaks various circuits through movable contacts on the switch body as the carriage travels. The switch also includes a plunger which, at first, is free to move relative to. the carriage, but upon installation is locked to the carriage, and a rotatable lever arm adjacent to the carriage and the plunger.

The rotatable lever arm holds the carriage in its desired neutral operating position at which it will normally remain. In this neutral operating position, the plunger is free to move relative to the carriage, and is lightly spring biased into its most extended position. When the switch body is installed, the plunger comes into contact with the brake arm which causes it to move against the force from the spring to assume a desired adjustment position relative to the carriage for proper operation.

Next, the rotatable lever arm is turned, first to lock the plunger to the carriage, and then to free the carriage for travel within the body. Thereafter, the carriage responds to movement of the plunger caused by the brake arm to make and break circuits in the normal fashion to control the operation of cruise control, stop lamps, etc. The operating position of the carriage relative to the switch body is maintained without further change.

Also, the length of the carriage is somewhat less than the space provided in the switch body. This permits overtravel of the carriage within the body without causing readjustment. Thus, when the brake pedal is inadvertently forced upward, the plunger merely forces the carriage backward into the overtravel space without readjusting the position of the plunger relative to the carriage or damaging the switch components.

BRIEF DESCRIPTION OF THE DRAWING

For a better understanding of the present invention, together with other objects, features and advantages, reference should be made to the following description of the preferred embodiment which should be read in conjunction with the following figures wherein like numerals represent like parts.

DETAILED DESCRIPTION OF THE INVENTION

Figure 1:
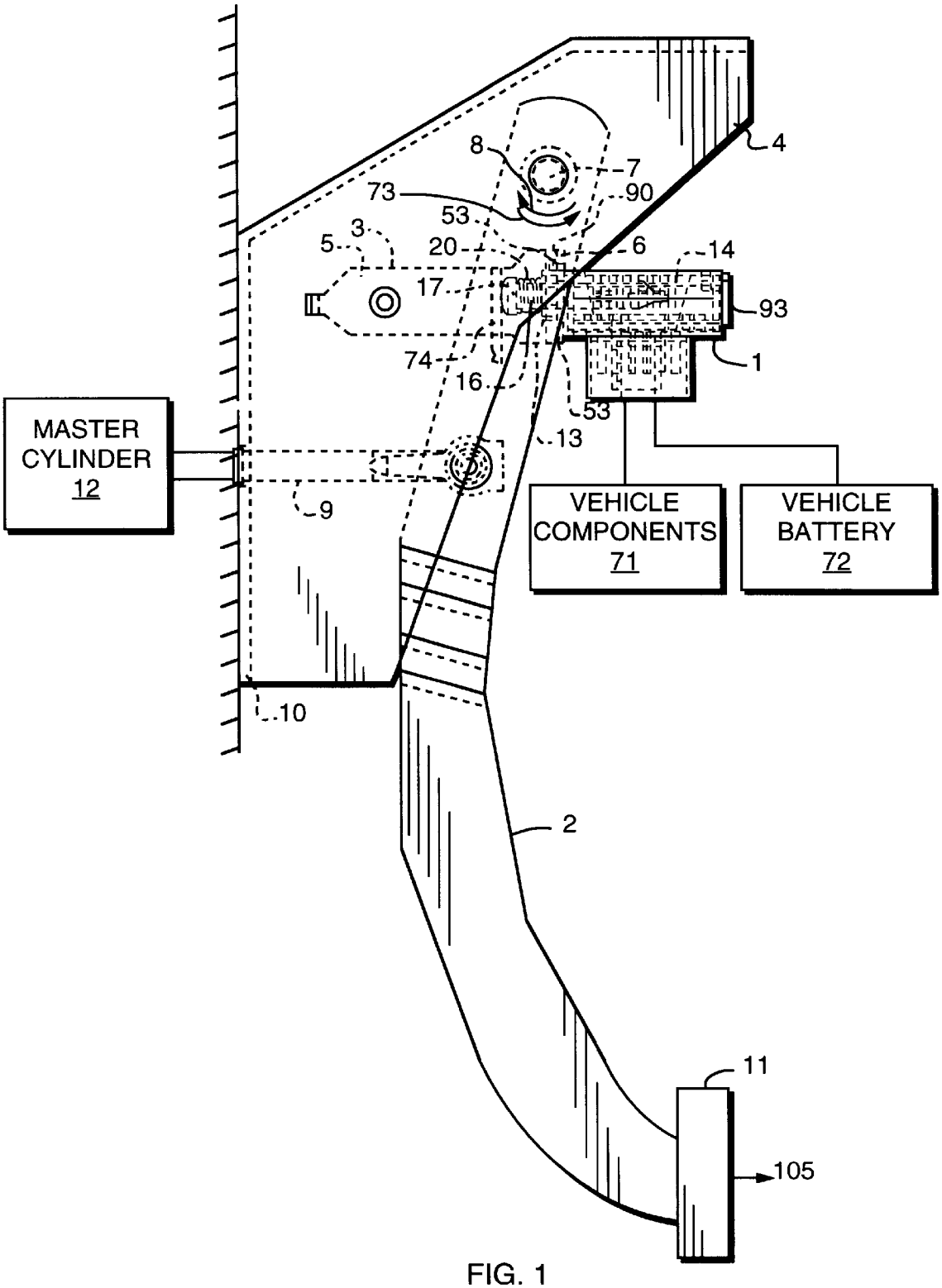
FIG. 1: is a side plan view of a brake pedal assembly showing the arrangement of a preferred switch according to the present invention relative thereto.

Referring to FIG. 1 of the drawing, there is shown the arrangement of a preferred switch 1 according to the present invention relative to a brake pedal arm 2. As shown, the switch 1 is mounted to a switch mounting plate 3 which is securely fixed to a console panel 4. Although many variations are possible, the preferred mounting plate includes a base portion 5 with a perpendicularly extending mounting flange 6 for receiving a rotatable sleeve 13 of the switch 1.

Figure 2:
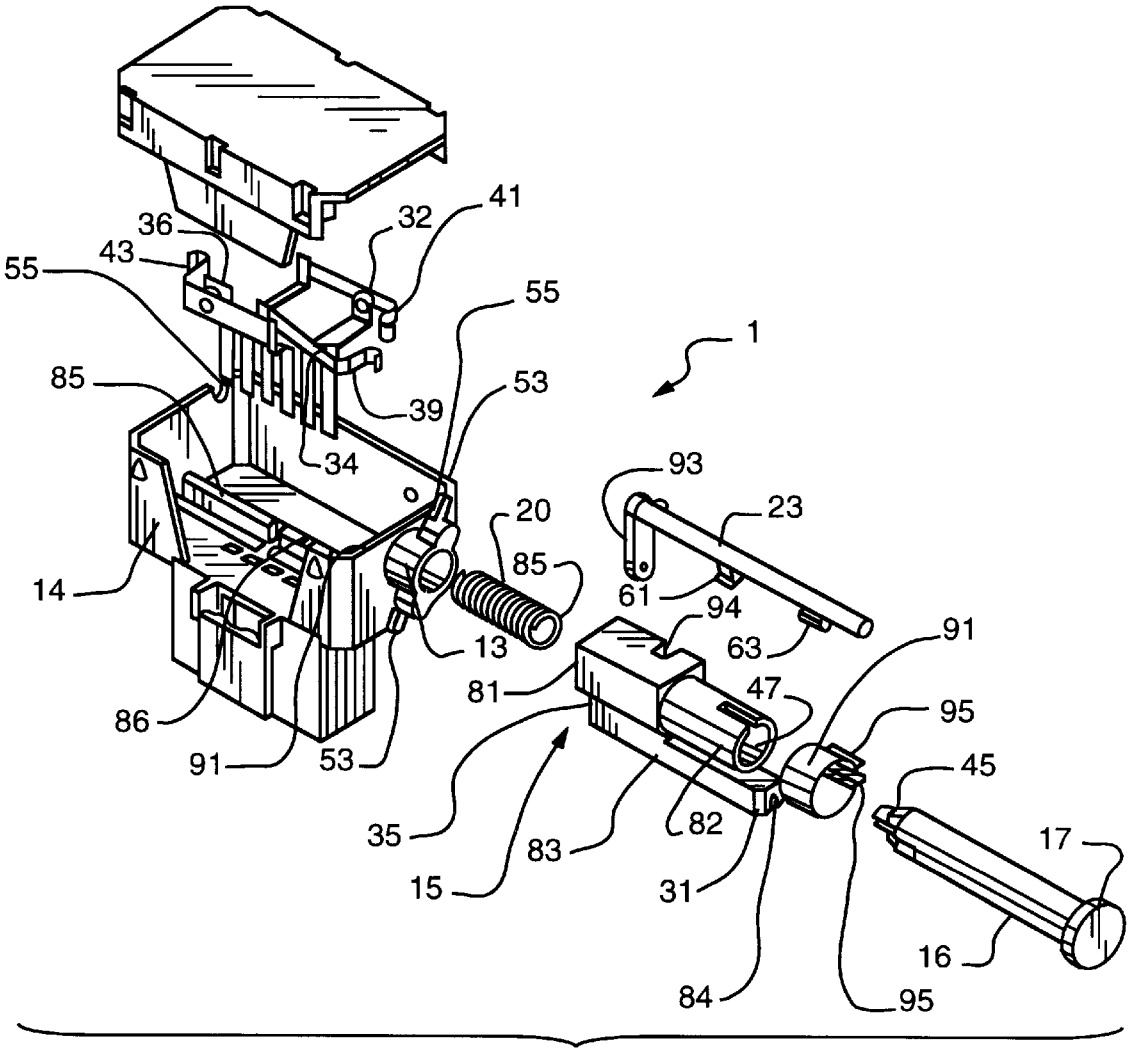
FIG. 2: is an exploded view of a preferred switch according to the present invention.

For mounting the switch to the mounting plate, the rotatable sleeve 13 is provided with projecting tangs 53, shown particularly in FIG. 2. The sleeve is inserted into an opening in the mounting flange 6 and rotated so that the projecting tangs rest against the exterior 90 of the mounting flange 6. Thus, the mounting flange is captured between the projecting tangs 53 and the wall 91 (FIG. 2) of the switch body to securely fix the switch to the mounting plate.

Fixed to the brake arm 2 is a striker plate 74 which is in pressing engagement with plunger 16 of the switch 1 when the brake pedal 2 is in an at rest (brakes off) position. As will be described in more detail below, the plunger 16 extends into the switch body 14 through sleeve 13 and compression spring 20 (FIG. 2). The spring 20 is coupled about the head 17 of the plunger to bias the plunger head 17 into contact with the brake arm striker plate 74 under a relatively light force, i.e., on the order of 2 lbs.

As is known, upon application of pressure to the brake pedal 11, i.e., when the brakes are "on", the brake arm 2 rotates about the fixed pin 7 in the direction of arrow 8. The rotation of the brake arm causes linear motion of master cylinder rod 9 through the vehicle fire wall 10 and into the master cylinder 12 to operate the vehicle brakes. The striker plate 74 rotates with the brake arm away from the plunger 16 which is urged under the force spring 20 to travel linearly outward from the switch body.

When pressure is removed, the brake arm rotates back to its at rest or "off" position in the direction of arrow 73, and the striker plate 74 forces the plunger back into the switch body 14. The linear travel of the plunger 16 causes linear travel of a carriage within the switch body which makes and breaks connections between switch arms and associated contacts to appropriately energize and deenergize vehicle components 72 (e.g. stop lamps, cruise control, motor control circuitry, etc.) through the vehicle battery 73.

The details of the switch 1 according to the present invention will now be described in connection with the exploded view thereof provided in FIG. 2. As shown, the switch body 14 houses a movable carriage 15 which has three major sections: a body section 81, a slotted cylindrical section 82, and a switch arm contacting section, 83. The switch arm contacting section 83 includes a slot 84 along the length thereof which slidingly engages projecting tabs 85,86 on the interior of the switch body 14. The mating of the slot 84 and the projecting tabs 85,86 ensures proper positioning of the carriage 15 within the body while allowing the carriage to slide linearly along the length of the projecting tabs 85,86.

The plunger 16 extends into the body through sleeve 13 and spring 20, and, prior to installation of the switch into the switch mounting plate 3 (FIG. 1), is loosely telescopically positioned within the opening 47 in the slotted cylindrical section 82. A C-clamp 91 surrounds the slotted cylindrical section with the plunger positioned therein. The C-clamp 91 is initially maintained in an open position to allow the plunger to move axially within the slotted cylindrical section 82. Upon installation, however, the C-clamp is closed to fix the position of the plunger relative to the carriage.

Prior to installation of the switch to the mounting plate, the carriage 15 is locked into a desired neutral position in the body 14 by lever arm 23. The lever arm is retained in openings 55 of the switch body in parallel relationship with the carriage 15 and plunger 16, and is rotatable within openings 55 by twisting of lever arm handle 93 which is positioned outside of the switch body for convenient access.

Figure 3:
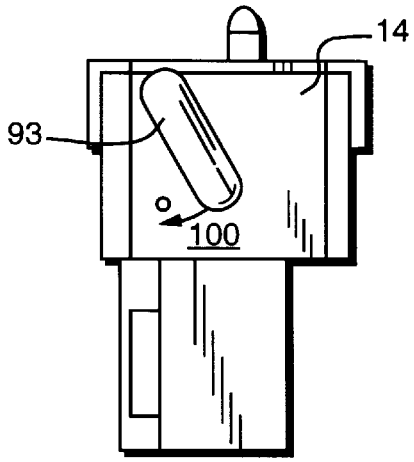
FIG. 3: is an end view of a switch according to the present invention showing the position of the lever arm handle prior to installation.

The pre-installation position of the lever arm handle 93 is as shown in FIG. 3. With lever arm handle in this position, a first radial extension 61 of the arm 23 releasably engages slot 94 in the body section 81 of the carriage. In this manner, the carriage is securely maintained in a desired neutral position within the body for installation. At the same time, a second extension 63, also extending radially from the lever arm 23, removably extends between flanges 95 of the C-clamp 91 to hold the C-clamp in open position and maintain the freedom of movement of the plunger within the slotted cylindrical section 82 of the carriage. Thus, prior to installation, the plunger 16 is biased into its most extended position by spring 20, but is free to travel linearly relative to the slotted cylindrical section of the carriage upon application of force sufficient to overcome the spring force, i.e., preferably about 2 lbs. At the same time, the carriage is held in a stationary position within the switch body by the releasable engagement of extension 61 and slot 94.

During assembly of the vehicle, the switch is mounted to the mounting plate, as described above, by locking the mounting flange between the projecting tangs 53 of the sleeve and the wall 91 of the switch body. As the switch is mounted in this fashion, the plunger pressingly engages the striker plate 74. Since the C-clamp 91 is maintained in an open position by extension 63 of the lever arm, the plunger moves axially into the cylindrical slotted section 82 of the carriage.

When the mounting of the switch to the mounting plate is complete, the lever arm handle 93 is simply rotated in the direction of arrow 100 (FIG. 3). This action first causes disengagement of the lever arm extension 63 from between the C-clamp flanges 95. As a result, the C-clamp closes tightly around the cylindrical slotted section 82 with the plunger extending therein to fix the relative positions of the plunger and the carriage. Continued rotation of the lever arm causes disengagement lever arm extension 61 from the slot 94, thus freeing the carriage for linear movement within the switch body to make or break switch contacts.

Advantageously, the switch according to the present invention completely obviates the disadvantages associated with prior art adjustment procedures since proper installation is not dependent upon the strength of the installer. As discussed above, the former practice was to install the switch and then pull upward on the brake pedal to force the plunger into a carriage within the switch housing. Thus, depending upon the strength of the installer, the adjustment of the plunger relative to the carriage varied. Oftentimes, improper adjustment of the switch resulted from this procedure causing malfunction of the switch.

With the switch of the present invention, adjustment of the position of the plunger within the cylindrical slotted section is accomplished in the act of mounting the switch to the mounting plate. The installer need only apply enough force in pressing the head 17 of the plunger against the striker plate to overcome the spring force and cause the plunger to extend into the cylindrical slotted section of the carriage. Once the switch is installed to the mounting plate 3, the lever arm handle is rotated to optimally fix the position of the plunger relative to the carriage. Uniform adjustment is thus achieved regardless of operator strength.

Figure 4A:
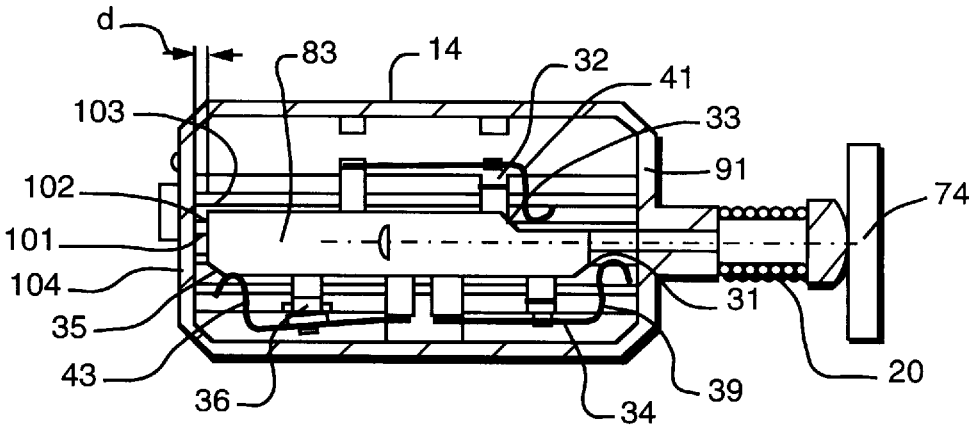
FIG. 4A: is a sectional view of a switch according to the present invention as installed in a vehicle with the brake pedal in the at rest or "off" position.
Figure 4B:
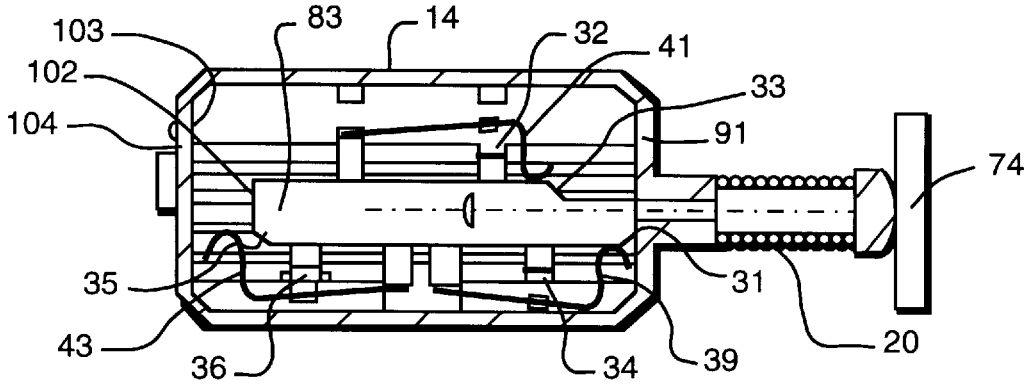
FIG. 4B: is a sectional view of a switch according to the present invention as installed in a vehicle with the brake pedal in the applied or "on" position.

Turning now to FIGS. 4A and 4B, the switch of the present invention is shown in two positions. The first, FIG. 4A, shows the switch with the brake pedal in an at rest or "off" position. In FIG. 4B, the switch is shown in its position when the brake pedal is in the down position and the brakes are applied or "on". Although a variety of switching arrangements could be provided, in the preferred embodiment three butt contacts 32, 34 and 36 are included in the switch body with associated switch arms 41, 39, and 43, respectively. The butt contacts may be electrically connected to the vehicle battery, and the switch arms to selected vehicle components/circuits, or vice-versa. For example, the switch arm 41 may be electrically connected to an engine controller, the switch arm 39 may be connected to a speed controller, and the switch arm 43 may be connected to the stop lamps.

The switch arm contacting section 83 of the carriage is profiled to form sloping cams, the cams 31, 33, and 35 being typical. With axial movement of the carriage within the housing, the cams pressingly engage the switch arms and the butt contacts. In FIG. 4A, with the brakes in the at rest or in the "off" position, it may be seen that the cam 31 is not in contact with switch arm 39 associated with butt contact 34. The cam 33 is similarly out of contact with switch arm 41 associated with butt contact 32. The cam 35 is in contact with switch arm 43, thus opening the connection between the switch arm 43 and butt contact 36 and, for example, deenergizing the stop lamps.

In FIG. 4B, the switch is shown with the brakes applied or in the "on" position. When the brakes are applied, the plunger moves outwardly from the switch body under the force of spring 20. The carriage slides linearly within the switch body toward wall 91 causing engagement and disengagement of the cams and switch arms. As shown, with the brakes applied or in the "on" position the cam 31 is in contact with switch arm 39 associated with butt contact 34, and the cam 33 is in contact with switch arm 41 associated with butt contact 32, thus opening butt contacts 34 and 32. The cam 35 is out of contact with switch arm 43, thus closing butt contact 36 and, for example, energizing the stop lamps.

Referring again to FIG. 4A, a particularly advantageous aspect of the present invention may be seen. The switch body of the present invention is sized to provide an overtravel protection space 101 between the end 102 of the carriage and the interior 103 of the end wall 104 of the switch body. In prior art designs, no such overtravel protection space is provided. When the brake pedal in these prior art designs is pulled upward (i.e. in the direction of the arrow 105 in FIG. 1) to adjust the switch, or is inadvertently pulled upward by the operator's foot, damage or readjustment of the switch can occur from the plunger forcing the carriage against the back wall of the switch housing.

The overtravel protection space 101 of the present invention provides protection for inadvertent or intentional upward movement of the brake arm. When the brake arm is pulled backward, the plunger forces the carriage toward the rear wall and into the overtravel protection space 101. The space 101 is sized to a width d, approximately 5 millimeters (mm) in the preferred embodiment, sufficient to account for any easily achieved upward movement of the brake pedal. Thus, to the extent that an operator could cause upward motion of the brake pedal without destroying or bending the brake arm and connected components, the overtravel protection space 101 is sufficiently sized to receive the end 102 of the carriage. The carriage, therefore, cannot be forced into the rear wall 104 of the switch body absent the application of some extraordinary force. This eliminates the problems of readjustment and damage caused in prior art switches as a result of upward motion of the brake arm.

Thus, according to the present invention there is provided an automotive switch which is self-adjusting, allowing facile and uniform adjustment upon installation. The adjustment is performed by the interaction of a rotatable lever arm which allows free movement of the plunger with respect to a stationary carriage prior to installation. Upon installation, the lever arm is rotated to fix the relative positions of the plunger and carriage, and to release the carriage for linear movement. In addition, the present invention includes an overtravel protection space for protecting against damage or readjustment caused by upward movement of the brake arm.

The embodiments which have been described herein, however, are but some of the several which utilize this invention and are set forth here by way of illustration but not of limitation. For example, the spring 20 could be installed in a variety of locations to achieve appropriate biasing. Also, the rotatable lever arm, the carriage, and the plunger could be arranged in a variety of ways to achieve the relative locking provided by the lever arm as described. It is obvious that many other embodiments, which will be readily apparent to those skilled in the art, may be made without departing materially from the spirit and scope of this invention.

What is claimed is:

1. A switch for making and breaking circuits in a vehicle in response to movement of the brake of said vehicle between active and rest positions comprising:

a switch body, a movable carriage disposed in said body, at least one set of electrical contacts mounted on said body adjacent to said carriage, said contacts being electrically connected to at least one of said circuits of said vehicle, said carriage being movable relative to said body causing making and breaking of said circuit in accordance with the position of said carriage relative to said body;

a striker plate fixed to said brake and movable therewith;

a plunger releasably connectable to said carriage to impart movement thereto, said plunger being movable in and extending from said body with one end of said plunger being urged into contact with said striker plate; and a lever arm mounted for rotation in said body adjacent to said carriage and said plunger, having at least a radial extension for alternately engaging and releasing said carriage for axial movement thereof in said body upon rotation of said lever arm.

2. A switch according to claim 1, wherein said at least one set of electrical contacts comprises a butt contact and a switch arm, and wherein said movable carriage is profiled to include at least one sloping cam, said cam being positioned to pressingly engage said switch arm to make or break electrical connection between said switch arm and said butt contact in accordance with the position of said carriage within said body.

3. A switch according to claim 1, wherein said movable carriage includes a slot therein, said radial extension releasably engaging said slot to maintain said carriage in a fixed position within said body, wherein rotation of said lever arm releases said radial extension from said slot to free said carriage for movement in said body.

4. A switch according to claim 3, said switch further including a C-clamp for connecting said carriage to said plunger, and wherein said lever arm includes a second radial extension engaging said C-clamp and maintaining freedom of movement of said plunger relative to said carriage, wherein rotation of said lever arm releases said second radial extension from said C-clamp to connect said plunger to said carriage.

5. A switch according to claim 4, wherein rotation of said lever arm first releases said second radial extension from said C-clamp to connect said plunger to said carriage, and second releases said radial extension from said slot to free said carriage for movement in said body.

6. A switch according to claim 1, wherein said movable carriage includes a cylindrical section, said plunger being movable in and extending from said cylindrical section, and wherein rotation of said lever arm clamps said plunger within said cylindrical section.

7. A switch according to claim 1, said switch further including a compression spring coupled to said plunger and biasing said plunger in an outward direction from said switch body and against said striker plate.

8. A switch according to claim 1, wherein said lever arm includes a lever arm handle disposed outside of said switch body for rotating said lever arm.

9. A switch according to claim 1, wherein said plunger is releasably connectable to a first end of said carriage to impart movement thereto, and wherein an overtravel protection space is provided between a second end of said carriage and an endwall of said switch body when said brake is in an at rest position.

10. A switch in accordance with claim 1, wherein said carriage has a first end to which said plunger is connectable and a second end which is spaced from an end wall of said switch body to provide for overtravel protection.

11. A switch according to claim 10, wherein said overtravel protection space is approximately 5 millimeters in width.

12. A method of installing a switch for a brake in a vehicle, said brake including a brake arm and a striker plate fixed to said brake arm, said method comprising:

providing a switch comprising:

a switch body, a movable carriage disposed in said body, at least one set of electrical contacts mounted on said body adjacent to said carriage, said contacts being electrically connected to at least one circuit of said vehicle, said carriage being movable relative to said body causing making and breaking of said circuit in accordance with the position of said carriage relative to said body, a plunger releasably connected to said carriage to impart movement thereto, said plunger movable in and extending from said body and being spring biased in an outward direction from said body, and a lever arm having radial extensions mounted for rotation in said body adjacent to said carriage and said plunger, wherein rotation of said lever arm moves said radial extensions to connect said plunger to said carriage and release said carriage for movement in said body;

mounting said switch to said vehicle adjacent said brake arm with one end of said plunger contacting said striker plate and being urged into said body; and rotating said lever arm to connect said plunger to said carriage and release said carriage for movement in said body.

13. A method of installing in a vehicle an automotive brake switch comprising a body, a carriage disposed for linear travel in said body, a plunger mounted on said carriage and normally biased by relatively light pressure to extend therefrom, a rotatable lever arm having radial extensions disposed on said body adjacent said carriage for locking said plunger to said carriage and freeing said carriage for travel in said body comprising the steps of installing said switch in said vehicle with said plunger in contact with said brake under pressure greater than said relatively light pressure and rotating said lever arm first to lock said plunger in fixed position on said carriage and second to free said carriage for predetermined linear movement in said body.

* * * * *